US007946102B2

(12) United States Patent
Karayianni et al.

(10) Patent No.: US 7,946,102 B2
(45) **Date of Patent: *May 24, 2011**

(54) FUNCTIONAL ELASTIC COMPOSITE YARN, METHODS FOR MAKING THE SAME AND ARTICLES INCORPORATING THE SAME

(75) Inventors: Eleni Karayianni, Geneva (CH); George W. Coulston, Pittsburgh, PA (US); Stacey B. Burr, West Lafayette, IN (US); Thomas A. Micka, West Grove, PA (US)

(73) Assignee: Textronics, Inc., Wilmington, DE (US)

( * ) Notice: Subject to any disclaimer, the term of this patent is extended or adjusted under 35 U.S.C. 154(b) by 542 days.

This patent is subject to a terminal disclaimer.

(21) Appl. No.: 11/719,105

(22) PCT Filed: Nov. 8, 2005

(86) PCT No.: PCT/IB2005/003338

§ 371 (c)(1),
(2), (4) Date: Jul. 16, 2008

(87) PCT Pub. No.: WO2006/051380

PCT Pub. Date: May 18, 2006

(65) Prior Publication Data

US 2009/0139601 A1 Jun. 4, 2009

Related U.S. Application Data

(60) Provisional application No. 60/627,169, filed on Nov. 15, 2004.

(51) Int. Cl.
*D02G 3/02* (2006.01)

(52) U.S. Cl. ..... 57/225

(58) Field of Classification Search ..... 57/210, 57/212, 213, 225, 239, 230, 3

See application file for complete search history.

(56) References Cited

U.S. PATENT DOCUMENTS

| | | | |
|---|---|---|---|
| 3,273,978 | A | 9/1966 | Victor |
| 3,288,175 | A | 11/1966 | Valko |
| 3,336,174 | A | 8/1967 | Dyer et al. |
| 3,354,630 | A | 11/1967 | Segal |
| 3,625,809 | A | 12/1971 | Caroselli et al. |
| 3,979,648 | A | 9/1976 | Toyoshima et al. |
| 4,160,711 | A | 7/1979 | Nishizawa et al. |
| 4,226,076 | A | 10/1980 | Griset, Jr. |
| 4,228,641 | A | 10/1980 | O'Neil |
| 4,239,046 | A | 12/1980 | Ong |
| 4,299,884 | A | 11/1981 | Payen et al. |
| 4,433,536 | A | 2/1984 | O'Neil |

(Continued)

FOREIGN PATENT DOCUMENTS

DE 10242785 A1 4/2004

(Continued)

*Primary Examiner* — Shaun R Hurley

(74) *Attorney, Agent, or Firm* — Connolly Bove Lodge & Hutz LLP

(57) ABSTRACT

A functional elastic composite yarn comprises an elastic member that is surrounded by at least one functional covering filament(s). The functional covering filament has a length that is greater than the drafted length of the elastic member such that substantially all of an elongating stress imposed on the composite yarn is carried by the elastic member. The elastic composite yarn may further include an optional stress-bearing member surrounding the elastic member and the functional covering filament.

48 Claims, 5 Drawing Sheets

U.S. PATENT DOCUMENTS 4,525,992 A 7/1985 Payen et al.
4,544,603 A 10/1985 Richards
4,572,960 A 2/1986 Ebneth et al.
4,583,547 A 4/1986 Granek et al.
4,651,163 A 3/1987 Sutera et al.
4,654,748 A 3/1987 Rees
4,777,789 A 10/1988 Kolmes et al.
4,813,219 A 3/1989 Rees
4,878,148 A 10/1989 Hee et al.
4,929,803 A 5/1990 Yoshida et al.
5,102,727 A 4/1992 Pittman et al.
5,103,504 A 4/1992 Dordevic
5,275,861 A 1/1994 Vaughn
5,288,544 A 2/1994 Mallen et al.
5,503,887 A 4/1996 Diaz et al.
5,632,137 A 5/1997 Kolmes et al.
5,771,027 A 6/1998 Marks et al.
5,906,004 A 5/1999 Lebby et al.
5,910,361 A 6/1999 Guevel et al.
5,927,060 A 7/1999 Watson
5,968,854 A 10/1999 Akopian et al.
6,105,224 A 8/2000 O'Mara, Jr. et al.
6,138,336 A 10/2000 Goineau
6,145,551 A 11/2000 Jayaraman et al.
6,341,504 B1 1/2002 Istook
6,356,238 B1 3/2002 Gainor et al.
6,377,216 B1 4/2002 Cheadle et al.
6,381,482 B1 4/2002 Jayaraman et al.
6,399,879 B1 6/2002 Ueda et al.
6,519,979 B2 2/2003 Freedman
6,581,366 B1 6/2003 Andrews
6,677,917 B2 1/2004 Van Heerden et al.
6,680,707 B2 1/2004 Allen et al.
6,701,703 B2 3/2004 Patrick
6,738,265 B1 5/2004 Svarfvar et al.
6,803,332 B2 10/2004 Andrews
6,856,715 B1 2/2005 Ebbesen et al.
6,970,731 B1 11/2005 Jayaraman et al.
7,059,714 B2 6/2006 Kaeding et al.
7,135,227 B2 11/2006 Karayianni et al.
7,147,904 B1 12/2006 Crawford
7,240,522 B2 7/2007 Kondou et al.
7,413,802 B2 8/2008 Karayianni et al.
7,504,127 B2 3/2009 Karayianni et al.
7,765,835 B2 * 8/2010 Karayianni et al. ..... 66/172 E
2002/0050446 A1 5/2002 Antoniazzi
2002/0130624 A1 9/2002 Nakamura
2002/0189839 A1 12/2002 Wagner et al.
2003/0224681 A1 12/2003 Koch
2004/0023576 A1 2/2004 Rock et al.
2004/0209059 A1 10/2004 Foss
2004/0216287 A1 11/2004 Bakker et al.
2004/0235381 A1 11/2004 Iwasaki et al.
2004/0237494 A1 12/2004 Karayianni et al.
2005/0282009 A1 12/2005 Nusko et al.

FOREIGN PATENT DOCUMENTS

WO 03027365 4/2003
WO 2004097089 A1 11/2004

* cited by examiner

FUNCTIONAL ELASTIC COMPOSITE YARN, METHODS FOR MAKING THE SAME AND ARTICLES INCORPORATING THE SAME

FIELD OF THE INVENTION

The present invention relates to elastified yarns containing functional filaments with tensile properties that are inadequate for textile applications, a process for producing the same, and to stretch fabrics, garments, and other articles incorporating such yarns.

BACKGROUND OF THE INVENTION

Fibers with functional properties have been disclosed for use in textile yarns. Such fibers may be added for the purpose of achieving a particular visual aesthetic, biological function, e.g., antimicrobial activity, thermal buffering effect, e.g., via incorporation of phase-changing materials into the fiber structure, electrical function, e.g., piezoelectric, electrostrictive, electrochromic activity, optical function, e.g., photonic crystal fibers, photoluminesce, luminescence, magnetic function e.g., magnetostrictive activity, thermoresponsive function, e.g., via shape memory polymers or alloys, or sensorial function, e.g., chemical, bio, capacitive, acoustic sensory activity. Such functional composite yarns have been fabricated into fabrics, garments and wearable/apparel articles.

Functional filaments can have inadequate tensile properties for textile manufacture or use. In many cases, a functional textile yarn is not based solely on functional filaments or on a combination yarn where the functional filaments are required to be a stressed member of the yarn. This can be due, for example, to the presence of particulates which have been added to a filament to impart the functionality. In such cases, the particle addition can increase fiber rigidity and/or decrease the breaking strength or decrease the yield strength. Alternatively, functionality may be achieved in such a way that the elastic limit of the functional filament is reduced, such that the fiber can no longer withstand the tensile stresses applied to fibers during conventional textile manufacturing processes.

U.S. Published Pat. Appln No. 2004/0209059 A1, discloses a functional composite yarn containing standard textile fibers and antimicrobial fibers. The standard textile fibers used in this composite functional yarn can, for example, include textile fibers such as nylon, polyester, cotton, wool, and acrylic. Such textile fibers have little or substantially no inherent elasticity. In other words, these standard textile fibers do not impart "stretch and recovery" power to the functional composite yarn. Although the composite yarn of this reference is a functional yarn, textile materials made therefrom would not be expected to provide textile fabrics and constructions therefrom having a stretch potential.

Similarly, WO 03/027365, to Haggard et al., discloses a functional fabric comprising phase-change material containing fibers. This reference discloses functional fibers comprising a sheath made from polyamides, polyesters and mixtures disclosed therein and including other synthetic polymers and a core made from a combination of hydrocarbon waxes, oils, fatty acid esters, and other phase-change materials disclosed therein. While fabrics made from such yarns may have satisfactory phase-changing properties; they would not be expected to possess an inherent elastic stretch and recovery property.

Yarns, fabrics or garments that have both stretch and recovery as well as some other advanced functionality are highly desired. The stretch and recovery property, or "elasticity", is the ability of a yarn or fabric to elongate in the direction of a biasing force (in the direction of an applied elongating stress) and return substantially to its original length and shape, substantially without permanent deformation, when the applied elongating stress is relaxed. In the textile arts it is common to express the applied stress on a textile specimen (e.g., a yarn or filament) in terms of (a) a force per unit of cross section area of the specimen or (b) force per unit linear density of the unstretched specimen. The resulting strain (elongation) of the specimen is expressed in terms of a fraction or percentage of the original specimen length. A graphical representation of stress versus strain is the stress-strain curve, which is well-known in the textile arts.

The degree to which fiber, yarn or fabric returns to the original specimen length prior to being deformed by an applied stress is called "elastic recovery" In stretch and recovery testing of textile materials, it is also important to note the elastic limit of the test specimen. The "elastic limit" is the stress load above which the specimen shows permanent deformation. The available elongation range of an elastic filament is that range of extension throughout which there is no permanent deformation. The elastic limit of a yarn is reached when the original test specimen length is exceeded after the deformation-inducing stress is removed. Typically, individual filaments and multifilament yarns elongate (strain) in the direction of the applied stress. This elongation is measured at a specified load or stress. In addition, it is useful to note the elongation at break of the filament or yarn specimen. This breaking elongation is that fraction of the original specimen length to which the specimen is strained by an applied stress, which ruptures the last component of the specimen filament or multifilament yarn. Generally, the drafted length is given in terms of a draft ratio equal to the number of times a yarn is stretched from its relaxed unit length.

In view of the foregoing, functional textile yarns with elastic recovery properties that can be processed using traditional textile means to produce knitted or woven fabrics ("functional textile yarns") continue to be sought. Fabrics and garments substantially constructed from elastic functional yarns can provide stretch and recovery characteristic to the entire construction, thus better conforming to any shape, any shaped body, or requirement for elasticity.

SUMMARY OF THE INVENTION

The present invention is directed to a functional elastic composite yarn that comprises an elastic member having a relaxed unit length L and a drafted length or (N×L). The elastic member itself comprises one or more filaments with elastic stretch and recovery properties. The elastic member is surrounded by at least one, but preferably a plurality of two or more, functional covering filament(s). Each functional covering filament has a length that is greater than the drafted length of the elastic member such that substantially all of an elongating stress imposed on the composite yarn is carried by the elastic member. The value of the number N is in the range of about 1.0 to about 8.0; and, more preferably, in the range of about 1.0 to about 5.0, most preferably in the range of about 1.0 to about 4.0.

The term "functional covering filament" refers to one or more fibers that has at least one functionality or exhibits at least one property that extends beyond mechanical properties commonly associated with textile fibers. Functionalities or properties associated with such members can, for example, include: biological activities; thermoresponsive activities; optical activities, such as light transmission, reflection, illumination or luminescence; activity under electrical, or magnetic fields; ability to convert energy from one form to another by responding to a stimuli; sensory, monitoring or actuation applications; and/or any other application or functionality referred to above. The functional covering filament may further include: piezoelectric, electrostrictive, ferroelectric, magnetostrictive, photonic, or electrochromic fibers.

Each of the functional covering filament(s) may take any of a variety of forms. The functional covering filament may be in the form of a particulate containing composite polymeric fiber. Alternatively the functional filament may take the form of a functional multi-component or multi-constituent inelastic synthetic polymeric fiber. Any combination of the various forms may be used together in a composite yarn having a plurality of functional covering filament(s).

Each functional filament is wrapped in turns about the elastic member such that for each relaxed (stress free) unit length (L) of the elastic member there is at least one (1) to about 10,000 turns of the functional covering filament. Alternatively, the functional covering filament may be sinuously disposed about the elastic member such that for each relaxed unit length (L) of the elastic member, there is at least one period of sinuous covering by the functional covering filament.

The composite yarn may further comprise one or more inelastic synthetic polymer yarn(s) surrounding the elastic member. Each inelastic synthetic polymer filament yarn has a total length less than the length of the functional covering filament, such that a portion of the elongating stress imposed on the composite yarn is carried by the inelastic synthetic polymer yarn(s). Preferably, the total length of each inelastic synthetic polymer filament yarn is greater than or equal to the drafted length (N×L) of the elastic member.

One or more of the inelastic synthetic polymer yarn(s) may be wrapped about the elastic member (and the functional covering filament) such that for each relaxed (stress free) unit length (L) of the elastic member there is at least one (1) to about 10,000 turns of inelastic synthetic polymer yarn. Alternatively, the inelastic synthetic polymer yarn(s) may be sinuously disposed about the elastic member such that for each relaxed unit length (L) of the elastic member there is at least one period of sinuous covering by the inelastic synthetic polymer yarn.

The composite yarn of the present invention has an available elongation range from about 10% to about 800%, which is greater than the break elongation of the functional covering filament and less than the elastic limit of the elastic member, and a breaking strength greater than the breaking strength of the functional covering filament.

The present invention is also directed to various methods for forming a functional elastic composite yarn.

A first method includes the steps of drafting the elastic member used within the composite yarn to its drafted length, placing each of the one or more functional covering filament(s) substantially parallel to and in contact with the drafted length of the elastic member, and thereafter allowing the elastic member to relax thereby entangling the elastic member and the functional covering filament(s). If the functional elastic composite yarn includes one or more inelastic synthetic polymer yarn(s), such inelastic synthetic polymer yarn(s) are placed substantially parallel to and in contact with the drafted length of the elastic member and, thereafter, the elastic member is allowed to relax thereby entangling the inelastic synthetic polymer yarn(s) with the elastic member and the functional covering filament(s).

In accordance with other alternative methods, each of the functional covering filament(s) and each of the inelastic synthetic polymer yarn(s) (if the same are provided) are either twisted about the drafted elastic member or, in accordance with another embodiment of the method, wrapped about the drafted elastic member. Thereafter, in each instance, the elastic member is allowed to relax.

Yet another alternative method for forming an functional elastic composite yarn in accordance with the present invention includes the steps of forwarding the elastic member through an air jet and, while within the air jet, covering the elastic member with each of the functional covering filament(s) and each of the inelastic synthetic polymer yarn(s) (if the same are provided). Thereafter, the elastic member is allowed to relax.

It also lies within the scope of the present invention to provide a knit or woven fabric substantially wholly constructed functional elastic composite yarns of the present invention. Such fabrics may be used to form a wearable garment or other fabric article.

BRIEF DESCRIPTION OF THE DRAWINGS

The invention will be more fully understood from the following detailed description, taken in connection with the accompanying drawings, which form a part of this application and in which.

DETAILED DESCRIPTION OF THE INVENTION

Figure 1:
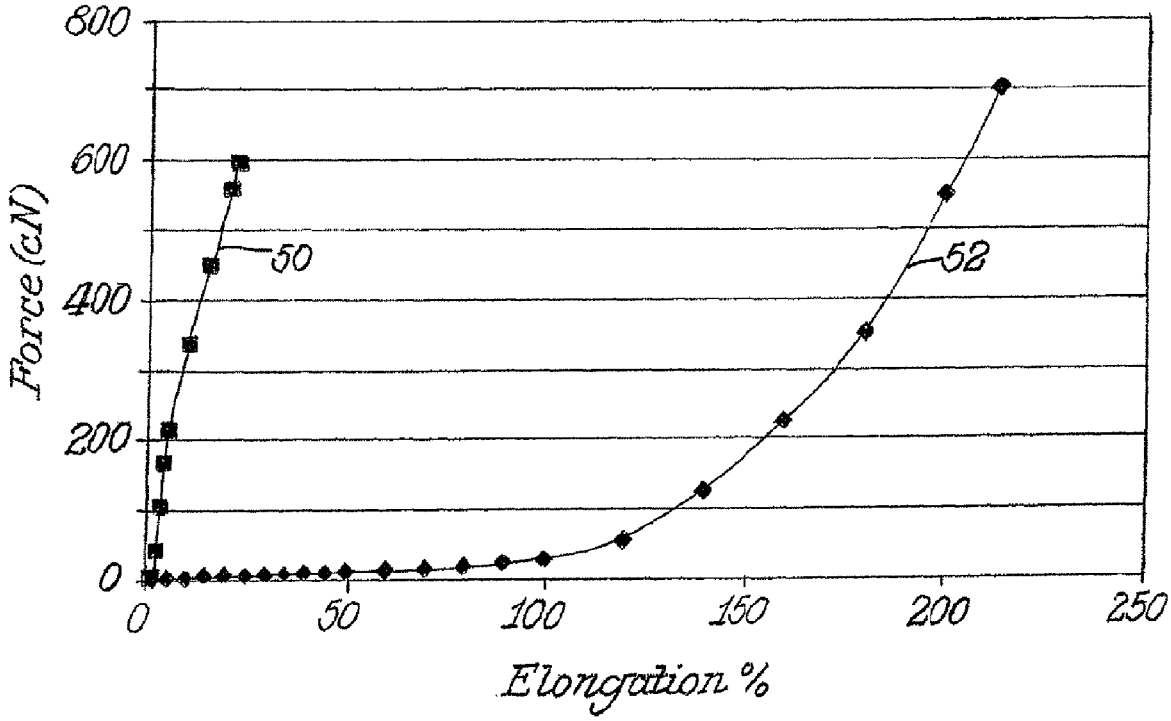
FIG. 1 shows stress-strain curves for the hollow fiber of Comparative Example 1 and, for comparison, the hollow fiber functional elastic composite yarn of Example 1.

In accordance with the present invention, functional elastic composite yarns containing functional fibers with low elastic limits, low tenacity at break, or both, are produced. The functional elastic composite yarns according to the present invention comprise an elastic member (or "elastic core") that is surrounded by at least one functional covering filament(s). Stated alternately, at least one functional covering filament is about or around said elastic member in the composite. The elastic member has a predetermined relaxed unit length L and a predetermined drafted length of (N×L), where N is a number, preferably in the range from about 1.0 to about 8.0, representing the draft applied to the elastic member.

The functional covering filament has a length that is greater than the drafted length of the elastic member such that, when the composite consists of the elastic member and the functional covering member, substantially all of an elongating stress imposed on the composite yarn is carried by the elastic member. In other words, substantially none of the stress is carried by the functional covering member, thus preserving the integrity and function of such functional covering member.

The elastic composite yarn may further include an optional stress-bearing member around or surrounding the elastic member and the functional covering filament. The stress-bearing member preferably is formed from one or more inelastic synthetic polymer yarn(s). The length of the stress-bearing member(s) is less than the length of the functional covering filament such that a portion of the elongating stress imposed on the composite yarn is carried by the stress-bearing member(s).

The Elastic Member

The elastic member may be implemented using one or a plurality (i.e., two or more) filaments of an elastic yarn, such as that spandex material sold by INVISTA North America S.à.r.l. (Wilmington, Del., USA, 19880) under the trademark LYCRA®.

The drafted length (N×L) of the elastic member is defined to be that length to which the elastic member may be stretched and return to within about five percent (5%) of its relaxed (stress free) unit length L. More generally, the draft N applied to the elastic member is dependent upon the chemical and physical properties of the polymer comprising the elastic, member and the covering and textile process used. In the covering process for elastic members made from spandex yarns, a draft of typically between about 1.0 and about 8.0, more preferably about 1.0 to about 5.0, and most preferably from about 1.0 to about 4.0, is present.

Alternatively, synthetic bicomponent multifilament textile yarns may also be used to form the elastic member. Synthetic bicomponent filament component polymers are typically thermoplastic. More preferably, the synthetic bicomponent filaments are melt spun, and most preferably the component polymers are selected from the group consisting of polyamides and polyesters.

A preferred class of polyamide bicomponent multifilament textile yarns includes those nylon bicomponent yarns which are self-crimping, also called "self-texturing". These bicomponent yarns comprise a component of nylon 66 polymer or copolyamide having a first relative viscosity and a component of nylon 66 polymer or copolyamide having a second relative viscosity, wherein both components of polymer or copolyamide are in a side-by-side relationship as viewed in the cross section of the individual filament. Self-crimping nylon yarn such as that yarn sold by INVISTA North America S.à.r.l. under the trademark TACTEL® T-800™ is an especially useful bicomponent elastic yarn.

The preferred polyester component polymers include polyethylene terephthalate, polytrimethylene terephthalate and polytetrabutylene terephthalate. The more preferred polyester bicomponent filaments comprise a component of PET polymer and a component of PTT polymer, both components of the filament may be In a side-by-side relationship as viewed in the cross section of the individual filament. An especially advantageous filament yarn meeting this description is that yarn sold by INVISTA North America S.à.r.l. under the trademark T-400™ Next Generation Fiber. The covering process for elastic members from these bicomponent yarns involves the use of less draft than with spandex.

Typically, the draft for both polyamide or polyester bicomponent multifilament textile yarns is between about 1.0 and about 5.0 and most preferably about 1.2 to about 4.0.

The Functional Covering Filament

In its most basic form, the functional covering filament comprises one or a plurality (i.e., two or more) strand(s) of functional fibers.

In an alternative form, the functional covering filament comprises a synthetic polymer yarn having one or more functional fibers(s) thereon. Suitable synthetic polymer yarns are selected from among continuous filament nylon yarns (e.g., from synthetic nylon polymers commonly designated as N66, N6, N610, N612, N7, N9), continuous filament polyester yarns (e.g. from synthetic polyester polymers commonly designated as PET, 3GT, 4GT, 2GN, 3GN, 4GN), staple nylon yarns, or staple polyester yarns. Such composite functional yarns may be formed by conventional yarn spinning techniques to produce composite yarns, such as plied, spun or textured yarns.

Whatever form chosen, the length of the functional covering filament around or surrounding the elastic member is determined according to the elastic limit of the elastic member. Thus, the functional covering filament around or surrounding a relaxed unit length L of the elastic member has a total unit length given by A(N×L), where A is some real number greater than one (1) and N is a number in the range of about 1.0 to about 8.0. Thus, the functional covering filament has a length that is greater than the drafted length of the elastic member.

An alternative form of the functional covering filament may be made by surrounding the synthetic polymer yarn with multiple turns of a functional fiber.

Optional Stress-Bearing Member

The optional stress-bearing member of the functional elastic composite yarn of the present invention may be made from nonfunctional inelastic synthetic polymer fiber(s) or from natural textile fibers like cotton, wool, silk and linen. These synthetic polymer fibers may be continuous filament or staple yarns selected from multifilament flat yarns, partially oriented yarns, textured yarns, bicomponent yarns selected from nylon, polyester or filament yarn blends.

If utilized, the stress-bearing member around or surrounding the elastic member is chosen to have a total unit length of B(N×L), where B is some real number greater than one (1). The choice of the numbers A (with respect to the functional covering member) and B (with respect to the optional stress-bearing member) determines the relative lengths of the functional covering filament and any stress-bearing member. Where A>B, for example, it is ensured that the conducting covering filament is not stressed or significantly extended near its breaking elongation. Furthermore, such a choice of A and B ensures that the stress-bearing member becomes the strength member of the composite yarn and will carry substantially all the elongating stress of the extension load at the elastic limit of the elastic member. Thus, the stress-bearing member has a total length less than the length of the functional covering filament such that a portion of the elongating stress imposed on the composite yarn is carried by the stress-bearing member. The length of the stress-bearing member should be greater than, or equal to, the drafted length (N×L) of the elastic member.

The stress-bearing member is preferably nylon. Nylon yarns comprised of synthetic polyamide component polymers, such as nylon 6, nylon 66, nylon 46, nylon 7, nylon 9, nylon 10, nylon 11, nylon 610, nylon 612, nylon 12 and mixtures and copolyamides thereof, are preferred. In the case of copolyamides, especially preferred are those including nylon 66 with up to 40 mole percent of a polyadipamide, wherein the aliphatic diamine component is selected from the group of diamines available from INVISTA North America S.à.r.l. (Wilmington, Del., USA, 19880) under the respective trademarks DYTEK A® and DYTEK EP®.

Making the stress-bearing member from nylon renders the composite yarn dyeable using conventional dyes and processes for coloration of textile nylon yarns and traditional nylon covered spandex yarns.

If the stress-bearing member is polyester, the preferred polyester is either polyethylene terephthalate (2GT, a.k.a. PET), polytrimethylene terephthalate (3GT, a.k.a. PTT) or polytetrabutylene terephthalate (4GT). Making the stress-bearing member from polyester multifilament yarns also permits ease of dyeing and handling in traditional textile processes.

The functional covering filament and the optional stress-bearing member can surround the elastic member in a substantially helical fashion along the axis thereof.

The relative amounts of the functional covering filament and the stress-bearing member (if used) are selected according to ability of the elastic member to extend and return substantially to its unstretched length (that is, undeformed by the extension) and on the electrical properties of the functional covering filament. As used herein "undeformed" means that the elastic member returns to within about +/−five percent (5%) of its relaxed (stress free) unit length L.

Any of the traditional textile processes for single covering, double covering, air jet covering, entangling, twisting or wrapping of elastic filaments with functional filament and the optional stress-bearing member yarns is suitable for making the functional elastic composite yarn according to the invention.

In most cases, the order in which the elastic member is surrounded by or covered by the functional covering filament and the optional stress-bearing member is immaterial for obtaining an elastic composite yarn. A desirable characteristic of these functional elastic composite yarns of this construction is their stress-strain behavior. For example, under the stress of an elongating applied force, the functional covering filament of the composite yarn, which is disposed about the elastic member in multiple wraps (typically from one turn (a single wrap) to about 10,000 turns), is tree to extend without strain due to the external stress.

Similarly, the optional stress-bearing member, which also is disposed about the elastic member in multiple wraps, (again, typically from one turn (a single wrap) to about 10,000 turns) is free to extend without significant strain. If the composite yarn is stretched near to the break extension of the elastic member, the stress-bearing member is available to take a portion of the load and effectively preserve the elastic member and the functional covering filament from breaking. The term "portion of the load" is used herein to mean any amount from about 1% to about 99 percent of the load, and more preferably from about 10% to about 80% of the load; and most preferably from about 25% to about 50% of the load.

Figure 5:
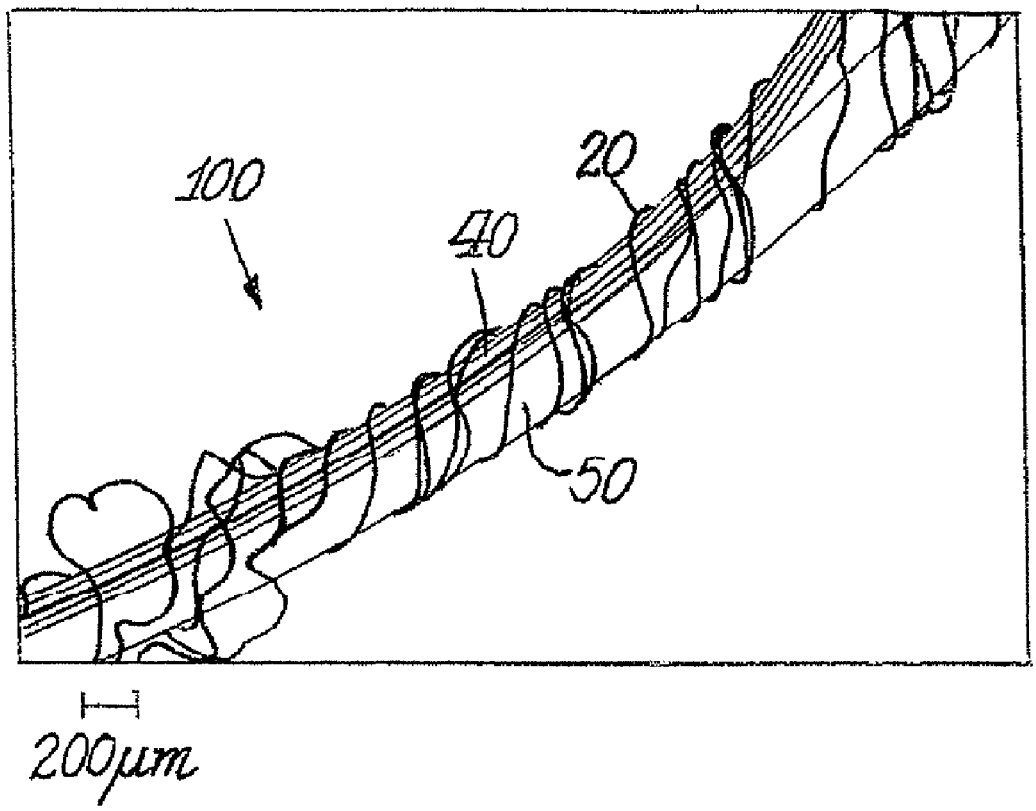
FIG. 5 is a schematic representation of an elastic composite yarn of the invention.

FIG. 5 illustrates a functional elastic composite yarn 100 that has an elastic member 40 covered by a functional covering filament 20 and a stress-bearing member 50. The functional elastic composite yarn 100 of this embodiment was formed by twisting.

Figure 6:
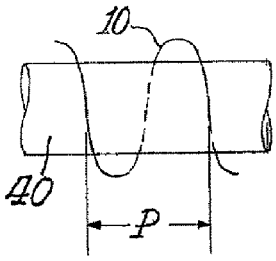
FIG. 6 shows a schematic representation of sinuous wrapping of an elastic member by a functional covering filament.

The elastic member may optionally be sinuously wrapped by the functional covering filament and the optional stress-bearing member. Sinuous wrapping is schematically represented in FIG. 6, where an elastic member 40, for example, a LYCRA® yarn, is wrapped with a functional covering filament 10, for example, a metallic wire, in such a way that the wraps are characterized by a sinuous period P.

Specific embodiments and procedures of the present invention will now be described further, by way of example, as follows.

Test Methods

Measurement of Fiber and Yarn Stress-Strain Properties

Fiber and Yarn Stress-Strain Properties were determined using a dynamometer at a constant rate of extension to the point of rupture. The dynamometer used was that manufactured by Instron Corp, 100 Royall Street, Canton, Mass., 02021 USA.

The test specimens were conditioned to about 22° C.±about 1° C. and about 60%±about 5% R.H. The test was performed at a gauge length of 5 cm and crosshead speed of about 50 cm/min. Threads measuring about 20 cm were removed from the bobbin and allowed to relax on a velvet board for at least 16 hours in air-conditioned laboratory, A specimen of this yarn was placed in the jaws with a pretension weight corresponding to the yarn dtex so as not to give either tension or slack. The results obtained from this method enable direct comparison between the functional elastic composite yarn and its components. It is expected that the pretension load influences available elongation of the yarn (that is, at a higher pretension load a lower available elongation is measured). Pretension load is not expected to influence the ultimate strength of the yarn.

Measurement of Fabric Stretch

Fabric stretch and recovery for a stretch woven fabric was determined using a universal electromechanical test and data acquisition system to perform a constant rate of extension tensile test. The system used was that from Instron Corp, 100 Royall Street, Canton, Mass., 02021 USA.

Two fabric properties were measured using this instrument: (1) fabric stretch and (2) the fabric growth (deformation). The available fabric stretch was measured as the amount of elongation caused by a specific load between 0 and about 30 Newtons and expressed as a percentage change in length of the original fabric specimen as it was stretched at a rate of about 300 mm per minute. The fabric growth was measured as the unrecovered length of a fabric specimen which had been held at about 80% of available fabric stretch for about 30 minutes then allowed to relax for about 60 minutes. Where 80% of available fabric stretch was greater than about 35% of the fabric elongation, this test was limited to about 35% elongation. The fabric growth was then expressed as a percentage of the original length.

The elongation or maximum stretch of stretch woven fabrics in the stretch direction was determined using a three-cycle test procedure. The maximum elongation measured was the ratio of the maximum extension of the test specimen to the initial sample length found in the third test cycle at load of about 30 Newtons. This third cycle value corresponds to hand elongation of the fabric specimen. This test was performed using the above-referenced universal electromechanical test and data acquisition system specifically equipped for this three-cycle test.

EXAMPLES

Comparative Example 1

A hollow fiber based on Polyester with Nr-18/1 (360 dtex) was examined for its stress and strain properties using the dynamometer and with an applied pretension load of about 400 mg. This fiber is branded Thermolite® and is a registered trademark for INVISTA, Inc. delivering maximum warmth and protection. The stress-strain curve of this fiber is shown in FIG. 1 at 50. This fiber exhibits a relatively high initial modulus and a relatively low elongation at break at less than about 30% of its test specimen length, characterized by a relatively high ultimate strength. Notably, where this fiber is used in textile fabrics and apparel, there is a severe limit to the elongation available. Such a fiber in garments, subject to stretch from movement of the wearer, would be expected to restrict the ultimate comfort of the garment in terms of freedom of movement.

Example 1

A 360 decitex (dtex) elastic core made of LYCRA® spandex yarn was wrapped with the Thermolite® yarn described in Comparative Example 1 using a standard spandex covering process. Covering was done on an I.C.B.T. machine model G307. During this process, LYCRA® spandex yarn was drafted to a value of 5 times (i.e., N=5), and was wrapped with two Thermolite® yarns of the same type, one twisted to the "S" and the other to the "Z" direction, to produce a hollow filament functional elastic composite yarn. The Thermolite® yarns were wrapped at about 1000 turns/meter (turns of Thermolite® yarn per meter of drafted Lycra® spandex yarn) (about 5000 turns for each relaxed unit length L) for the first covering and at about 800 turns/meter (about 4000 turns for each relaxed unit length L) for the second covering. The stress-strain curve 52 shown in FIG. 1 is for the hollow fiber functional elastic composite yarn measured as in Comparative Example 1 with an applied pretension load of about 400 mg. This hollow fiber functional elastic composite yarn exhibits an exceptional stretch behavior to over about 100% more than the test specimen length and elongates to the range of about 200% before it breaks, exhibiting a higher ultimate strength than the Thermolite® yarns individually. This process allows production of a hollow fiber functional elastic composite yarn that exhibits an elongation to break in the range of about 200% and a force to break in the range of about 700 cN, compared to the individual Thermolite® yarn that exhibits an elongation to break of only about 22% and a force to break of about 590 cN. As can be seen from the characteristic stress-strain curve 52 of this example, the break of the hollow fiber functional elastic composite yarn is caused by the functional yarn breaking before the elastic member of the composite yarn breaks.

Comparative Example 2

Figure 2:
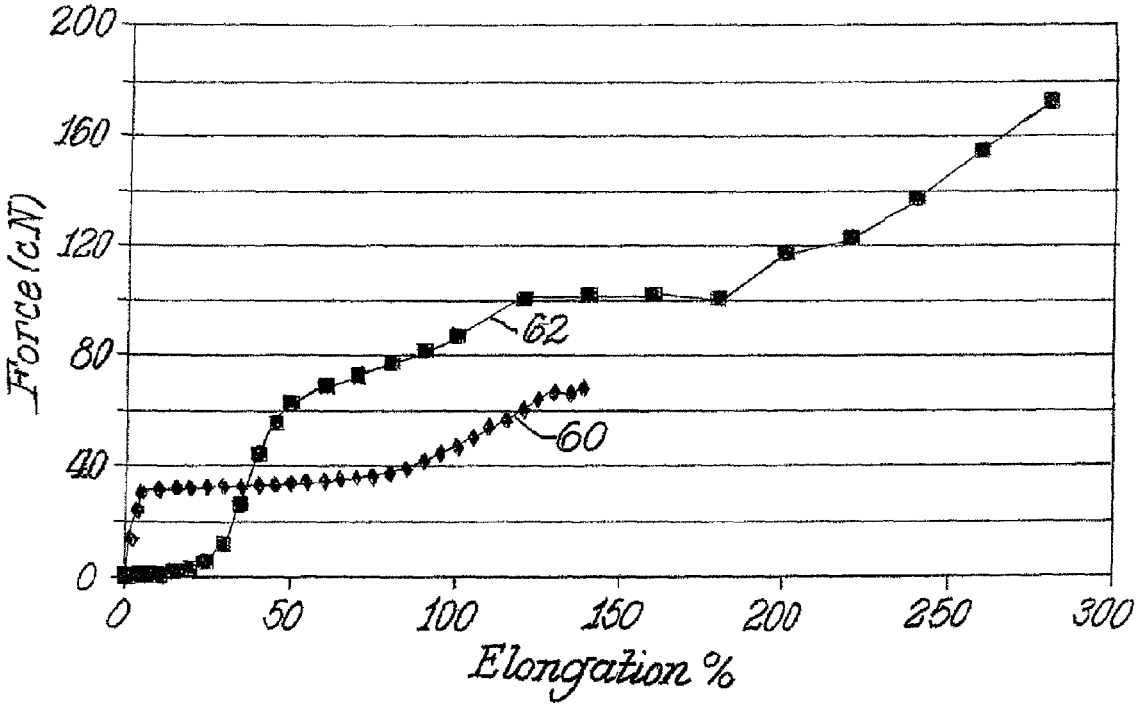
FIG. 2 shows stress-strain curves for the phase change continuous filament yarn of Comparative Example 2 and, for comparison, the phase change functional elastic composite yarn of Example 2.

A bicomponent core-sheath fiber containing a loading of phase change particles in the sheath was examined for its stress and strain properties using the dynamometer and with an applied pretension load of about 100 mg. This fiber is type D22 developed by INVISTA, Inc. and is an 86den 34 continuous filament yarn. The stress-strain curve 60 of this fiber is shown in FIG. 2. This fiber exhibits a relatively high initial modulus with a yield point at only about 5% followed by a relatively high elongation at break to about 150% of its test specimen length. Notably, where this fiber is used in textile fabrics and apparel, there is a severe limit to the mechanical properties of the textile characterized by a high toughness at the very low elongation range, which is the useful comfort range for wearables. Such a fiber in garments, subject to stretch from movement of the wearer, would be expected to restrict the ultimate comfort of the garment in terms of freedom of movement.

Example 2

A 44 decitex (dtex) elastic core made of LYCRA® spandex yarn was wrapped with the D22 yarn described in Comparative Example 2, using a standard spandex covering process. Covering was done on an I.C.B.T. machine model G307. During this process, LYCRA® spandex yarn was drafted to a value of 3.2 times (i.e., N=3.2) and was wrapped with two D22 yarns of the same type, one twisted to the "S" and the other to the "Z" direction, to produce a phase change filament functional elastic composite yarn. The D22 yarns were wrapped at about 1500 turns/meter (turns of D22 yarn per meter of drafted Lycra® spandex yarn) (about 4800 turns for each relaxed unit length L) for the first covering and at about 1200 turns/meter (about 3840 turns for each relaxed unit length L) for the second covering. The stress-strain curve 62 shown in FIG. 2 is for a phase change fiber functional elastic composite yarn measured as in Comparative Example 1 with an applied pretension load of about 100 mg. This phase change fiber functional elastic composite yarn exhibits an elastic modulus to about 30% more than the test specimen length and elongates to the range of about 300% before it breaks, exhibiting a higher ultimate strength than the D22 yarns individually. This process allows production of a phase change fiber functional elastic composite yarn that exhibits an elongation to break in the range of about 300% and a force to break in the range of about 180 cN, compared to the individual D22 yarn that exhibits an elongation to break of about 150% and a force to break of about 70 cN (see FIG. 2). This process also yields a functional composite yarn with a yield point at about 50% elongation, a range higher than the individual D22 yarn that yields at only about 5% elongation. This is a significant advantage for use of textiles in that useful elongation range. As can be seen from the characteristic stress-strain curve of this example (62 in FIG. 2), the break of the hollow fiber functional elastic composite yarn is caused by the functional yarn breaking before the elastic member of the composite yarn breaks.

Comparative Example 3

Figure 3:
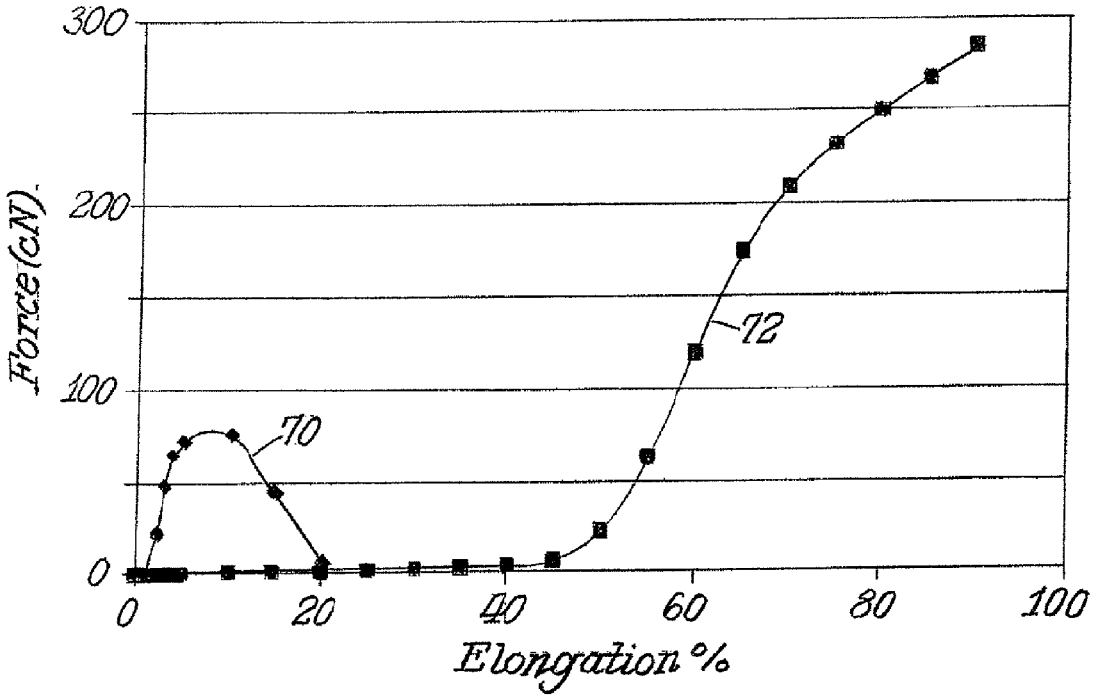
FIG. 3 shows stress-strain curves for the phase change continuous filament yarn of Comparative Example 3 and, for comparison, the phase change functional elastic composite yarn of Example 3.

A bicomponent core-sheath fiber containing a loading of phase change particles in the sheath was examined for its stress and strain properties using the dynamometer and with an applied pretension load of about 50 mg. This fiber is type D22 developed by INVISTA and is an 48den 34 continuous filament yarn. The stress-strain curve 70 of this fiber is shown in FIG. 3. This fiber exhibits a quite high initial modulus with a quite low elongation at break to about 10% of its test specimen length. Notably, where this fiber is used in textile fabrics and apparel, there is a severe limit to the elongation available. Such a fiber in garments, subject to stretch from movement of the wearer, would be expected to restrict the ultimate comfort of the garment in terms of freedom of movement.

Example 3

A 44 decitex (dtex) elastic core made of LYCRA® spandex yarn was wrapped with the D22 yarn described in Comparative Example 3 using a standard spandex covering process. Covering was done on an I.C.B.T. machine model G307. During this process, LYCRA® spandex yarn was drafted to a value of 3.2 times (i.e., N=3.2), and was wrapped with two D22 yarns of the same type, one twisted to the "S" and the other to the "Z" direction, to produce a phase change filament functional elastic composite yarn. The D22 yarns were wrapped at about 1500 turns/meter (turns of D22 yarn per meter of drafted Lycra® spandex yarn) (about 4800 turns for each relaxed unit length L) for the first covering and at about 1200 turns/meter (about 3840 turns for each relaxed unit length L) for the second covering. The stress-strain curve 72 shown in FIG. 3 is for phase change fiber functional elastic composite yarn measured as in Comparative Example 3 with an applied pretension load of about 50 mg. This phase change fiber functional elastic composite yarn exhibits an elastic modulus to about 50% more than the test specimen length and elongates to the range of about 90% before it breaks, exhibiting a higher ultimate strength than the D22 yarns individually. This process allows production of a phase change fiber functional elastic composite yarn that exhibits an elongation to break in the range of about 90% and a force to break in the range of about 280 cN, compared to the individual D22 yarn that exhibits an elongation to break of only about 10% and a force to break of about 80 cN. As can be seen from the characteristic stress-strain curve 72 of this example, the break of the hollow fiber functional elastic composite yarn is caused by the functional yarn breaking before the elastic member of the composite yarn breaks.

Comparative Example 4

Figure 4:
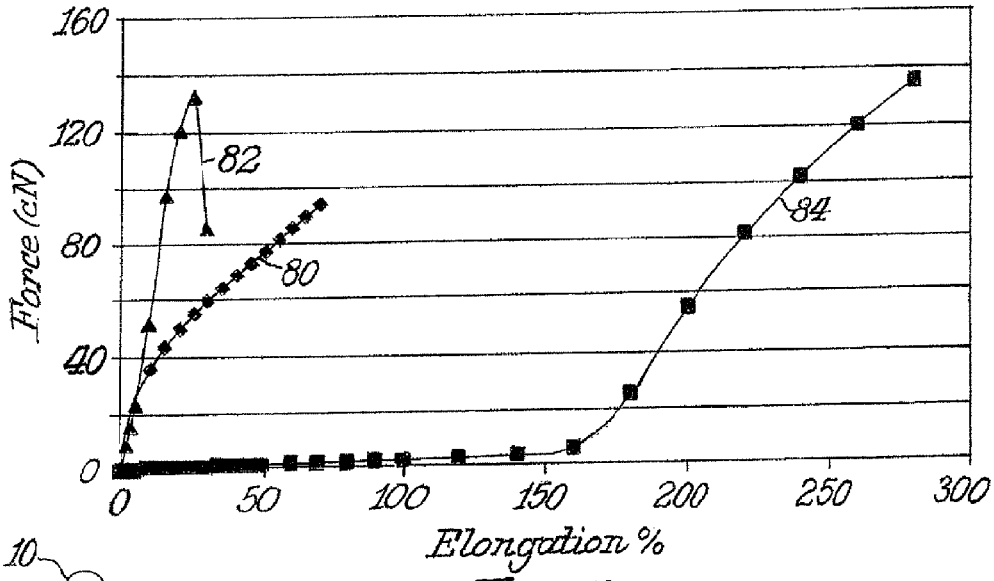
FIG. 4 shows stress-strain curves for the carbon black loaded yarn of Comparative Example 4 and, for comparison, the functional elastic composite yarn of Example 4.

A polyamide fiber containing a loading of carbon black particles was examined for its stress and strain properties using the dynamometer and with an applied pretension load of about 50 mg. This fiber is Tactel® POY yarn, a registered trademark by INVISTA, and is an 28den 10 filament continuous filament yarn. The stress-strain curve 80 of this fiber is shown in FIG. 4. This fiber exhibits a relatively high initial modulus with a subtle yield point at about 20% elongation and with an elongation at break to about 70% of its test specimen length. Notably, where this fiber is used in textile fabrics and apparel, there is a severe limit to the elongation available. Such a fiber in garments, subject to stretch from movement of the wearer, would be expected to restrict the ultimate comfort of the garment in terms of freedom of movement. As a comparison in FIG. 4, there is also included the stress-strain curve 82 of the reference fiber without the loading of carbon black particles. It can be seen from such comparison that the loading of the functional particles imposes a yield and reduces significantly the ultimate strength of the fiber compared to the reference fiber that shows a continuous increase of its stress with increasing strain up till the breaking point.

Example 4

A 44 decitex (dtex) elastic core made of LYCRA® spandex yarn was wrapped with the Tactel® yarn described in Comparative Example 4 using a standard spandex covering process. Covering was done on an I.C.B.T. machine model G307. During this process, LYCRA® spandex yarn was drafted to a value of 3.2 times (i.e., N=3.2), and was wrapped with two Tactel® yarns of the same type, one twisted to the "S" and the other to the "Z" direction, to produce a phase change filament functional elastic composite yarn. The Tactel® yarns were wrapped at about 1500 turns/meter (turns of D22 yarn per meter of drafted Lycra® spandex yarn) (about 4800 turns for each relaxed unit length L) for the first covering and at about 1200 turns/meter (about 3840 turns for each relaxed unit length L, for the second covering. The stress-strain curve 84 shown in FIG. 4 is for a carbon black fiber functional elastic composite yarn measured as in Comparative Example 4 with an applied pretension load of about 50 mg. This functional elastic composite yarn exhibits an exceptional stretch behavior to about 160% more than the test specimen length and elongates to the range of about 280% before it breaks, exhibiting a higher ultimate strength than the Tactel® yarns individually and a similar ultimate strength to the reference Tactel® yarn alone. This process allows production of a black dyed fiber functional elastic composite yarn that exhibits an elongation to break in the range of about 280% and a force to break in the range of about 140 cN, compared to the individual Tactel® yarn that exhibits an elongation to break of about 70% and a force to break of about 90 cN. As can be seen from the characteristic stress-strain curve 84 of this example, the break of the black functional elastic composite yarn is caused by the functional yarn breaking before the elastic member of the composite yarn breaks.

The examples are for the purpose of illustration only. Many other embodiments falling within the scope of the accompanying claims will be apparent to the skilled person.

What is claimed is:

1. A functional elastic composite yarn, comprising:

at least one elastic member having a relaxed unit length L and a drafted length of (N×L), wherein N is in the range of about 1.0 to about 8.0; and at least one functional covering filament around the elastic member, the functional covering filament having a length that is greater than the drafted length of the elastic member, wherein the functional covering filament adds at least one property to the yarn selected from the group consisting of biological, electrical, optical, magnetic, thermoresponsive, sensory and actuation properties, such that a portion of an elongating stress imposed on the composite yarn is carried by the elastic member.

2. The functional elastic composite yarn of claim 1, wherein N is in the range of about 1.0 to about 5.0.

3. The functional elastic composite yarn of claim 1, wherein the at least one functional covering filament has a breaking strength of less than about 4 N at breaking elongation of less than about 30%.

4. The functional elastic composite yarn of claim 1, wherein the at least one functional covering filament comprises a hollow fiber.

5. The functional elastic composite yarn of claim 1, wherein the at least one functional covering filament comprises a particle-polymer composite.

6. The functional elastic composite yarn of claim 1, wherein the at least one functional covering filament is a filament with a yield point or a yield strength of less than about 4 N at a yield elongation of less than about 30%.

7. The functional elastic composite yarn of claim 1, wherein the at least one functional covering filament has a sheath-core structure, wherein the sheath comprises a material selected from the group consisting of a polyester, a nylon, a polyolefin, and an acrylic, and mixtures of the same, and the core imparts the desired functionality.

8. The functional elastic composite yarn of claim 1, wherein the at least one functional covering filament has a sheath-core structure, wherein the core comprises a material selected from the group consisting of a polyester, a nylon, a polyolefin, and an acrylic, and mixtures of the same, and the sheath imparts the desired functionality.

9. The functional elastic composite yarn of claim 1, wherein the at least one elastic member has a predetermined elastic limit, the at least one functional covering filament has a predetermined break elongation, and the composite yarn has an available elongation range that is greater than the break elongation of the at least one functional covering filament and less than the elastic limit of the at least one elastic member.

10. The functional elastic composite yarn of claim 1, wherein the at least one elastic member has a predetermined elastic limit, the at least one functional covering filament has a predetermined break elongation, and the composite yarn has an elongation range from about 10% to about 800%.

11. The functional elastic composite yarn of claim 1, wherein the at least one functional covering filament has a predetermined breaking strength, and wherein the composite yarn has a breaking strength greater than the breaking strength of the at least one functional covering filament.

12. The functional elastic composite yarn of claim 1, wherein the at least one functional covering filament comprises a non-functional inelastic synthetic polymer yarn having a functional fiber thereon.

13. The functional elastic composite yarn of claim 1, wherein the at least one functional covering filament is wrapped in turns about the elastic member, such that for each relaxed unit length (L) of the elastic member there is at least one (1) to about 10,000 turns of the functional covering filament.

14. The functional elastic composite yarn of claim 1, wherein the at least one functional covering filament is sinuously disposed about the elastic member such that for each relaxed unit length (L) of the elastic member there is at least one period of sinuous covering by the functional covering filament.

15. The functional elastic composite yarn of claim 1, further comprising a second functional covering filament around the elastic member, the second functional covering filament having a length that is equal to or greater than the drafted length of the elastic member.

16. The functional elastic composite yarn of claim 15, wherein the second functional covering filament is (a) a composite comprising a polymer matrix selected from the group consisting of a polyester, a nylon, a polyolefin, and an acrylic, and a sufficiently high loading of particulates, or (b) is a hollow fiber, and wherein the breaking strength of the second functional covering filament is lower than breaking strength of the functional composite yarn.

17. The functional elastic composite yarn of claim 15, wherein the second functional covering filament has a breaking elongation that is lower than the breaking elongation of the functional composite yarn.

18. The functional elastic composite yarn of claim 16, wherein the second functional covering filament comprises a non-functional inelastic synthetic polymer yarn comprising a functional fiber.

19. The functional elastic composite yarn of claim 15, wherein the second functional covering filament is wrapped in turns about the elastic member, such that for each relaxed unit length of the core there is at least one (1) to about 10,000 turns of the second functional covering filament.

20. The functional elastic composite yarn of claim 15, wherein the second functional covering filament is sinuously disposed about the elastic member such that for each relaxed unit length (L) of the elastic member there is at least one period of sinuous covering by the second functional covering filament.

21. The functional elastic composite yarn of claim 1, wherein substantially all of the elongating stress imposed on the composite yarn is carried by the elastic member.

22. The functional elastic composite yarn of claim 1, further comprising:

a stress-bearing member around the elastic member, wherein the stress-bearing member has a total length less than the length of the functional covering filament and greater than, or equal to, the drafted length (N ×L) of the elastic member, such that a portion of the elongating stress imposed on the composite yarn is carried by the stress-bearing member.

23. The functional elastic composite yarn of claim 22, wherein substantially all of the elongating stress imposed on the composite yarn is carried by the stress-bearing member.

24. The functional elastic composite yarn of claim 22, wherein the stress-bearing member comprises an inelastic synthetic polymer yarn.

25. The functional elastic composite yarn of claim 22, wherein the stress-bearing member is wrapped in turns about the elastic member such that for each relaxed unit length (L) of the elastic member there is at least one (1) to about 10,000 turns of stress-bearing member.

26. The functional elastic composite yarn of claim 22, wherein the stress-bearing member is sinuously disposed about the elastic member such that for each relaxed unit length (L) of the elastic member there is at least one period of sinuous covering by the stress-bearing member.

27. The functional elastic composite yarn of claim 24, wherein the stress-bearing member further comprises:

a second inelastic synthetic polymer yarn surrounding the elastic member, and wherein the second inelastic synthetic polymer yarn has a total length less than the length of the functional covering filament and greater than, or at most equal to, the drafted length of (N×L) of the elastic member, such that a portion of the elongating stress imposed on the composite yarn is carried by the second inelastic synthetic polymer yarn.

28. The functional elastic composite yarn of claim 27, wherein the second inelastic synthetic polymer yarn is wrapped in turns about the elastic member such that for each relaxed unit length (L) of the elastic member there is at least one (1) to about 10,000 turns of each inelastic synthetic polymer yarn.

29. The functional elastic composite yarn of claim 27, wherein the second inelastic synthetic polymer yarns is sinuously disposed about the elastic member such that for each relaxed unit length (L) of the elastic member there is at least one period of sinuous covering by each inelastic synthetic polymer yarn.

30. A method for forming a functional elastic composite yam, comprising:

(1) providing:

(a) an elastic member having a relaxed length; and (b) at least one nonmetallic functional covering filament;

(2) drafting the elastic member;

(3) placing the functional covering filament substantially parallel to and in contact with the drafted length of the elastic member; and (4) allowing the elastic member to relax to entangle the elastic member and the functional covering filament to form the composite yarn, wherein the at least one functional covering filament adds at least one property to the yarn selected from the group consisting of biological, electrical, optical, magnetic, thermo-responsive, sensory and actuation properties.

31. The method of claim 30, wherein the method further comprises providing a second functional covering filament, placing the second functional covering filament substantially parallel to and in contact with the drafted length of the elastic member; and allowing the elastic member to relax to entangle the second functional covering filament with the elastic member and the functional covering filament.

32. The method of claim 30, wherein the method further comprises providing an inelastic synthetic polymer yarn, placing the inelastic synthetic polymer yarn substantially parallel to and in contact with the drafted length of the elastic member; and allowing the elastic member to relax to entangle the inelastic synthetic polymer yarn with the elastic member and the first functional covering filament.

33. The method of claim 32, wherein the method further comprises providing a second inelastic synthetic polymer yarn, placing the second inelastic synthetic polymer yarn substantially parallel to and in contact with the drafted length of the elastic member; and allowing the elastic member to relax to entangle the second inelastic synthetic polymer yarn with the elastic member, the functional covering filament, and the first inelastic synthetic polymer yarn.

34. A method for forming a functional elastic composite yarn, comprising:

(1) providing:

(a) an elastic member having a relaxed length; and (b) at least one non-metallic functional covering filament, wherein the functional covering filament adds at least one property to the yarn selected from the group consisting of biological, electrical, optical, magnetic, thermoresponsive, sensory and actuation properties;

(2) drafting an elastic member;

(3) twisting the functional covering filament with the drafted elastic member; and (4) allowing the elastic member to relax.

35. The method of claim 34, wherein the method further comprises providing a second functional covering filament, twisting the second functional covering filament with the drafted elastic member and the first functional covering filament; and allowing the elastic member to relax.

36. The method of claim 35, wherein the method further comprises:

providing an inelastic synthetic polymer yarn, twisting the inelastic synthetic polymer yarn with the elastic member and the functional covering filament; and allowing the elastic member to relax.

37. The method of claim 36, wherein the method further comprises:

providing a second inelastic synthetic polymer yarn, twisting the second inelastic synthetic polymer yarn with the elastic member, the functional covering filament, and the first inelastic synthetic polymer yarn; and allowing the elastic member to relax.

38. A method for forming a functional elastic composite yarn, comprising:

(1) providing:

(a) an elastic member having a relaxed length; and (b) at least one non-metallic functional covering filament, wherein the functional covering filament adds at least one property to the yarn selected from the group consisting of biological, electrical, optical, magnetic, thermoresponsive, sensory and actuation properties;

(2) drafting the elastic member;

(3) wrapping the functional covering filament about the drafted length of the elastic member; and (4) allowing the elastic member to relax.

39. The method of claim 38, wherein the method further comprises:

providing a second functional covering filament, wrapping the second functional covering filament about the drafted length of the elastic member and the first functional covering filament; and allowing the elastic member to relax.

40. The method of claim 38, wherein the method further comprises providing an inelastic synthetic polymer yarn, wrapping the inelastic synthetic polymer yarn about the drafted length of the elastic member and the functional covering filament; and allowing the elastic member to relax.

41. The method of claim 40, wherein the method further comprises providing a second inelastic synthetic polymer yarn, wrapping the second inelastic synthetic polymer yarn about drafted length of the elastic member, the functional covering filament, and the first inelastic synthetic polymer yarn; and allowing the elastic member to relax.

42. A method for forming a functional elastic composite yarn, comprising:

(1) providing:

(a) an elastic member having a relaxed length; and (b) at least one functional covering filament, wherein the functional covering filament adds at least one property to the yarn selected from the group consisting of biological, electrical, optical, magnetic, thermoresponsive, sensory and actuation properties;

(2) forwarding the elastic member through an air jet;

(3) within the air jet, covering the elastic member with the functional covering filament; and (4) allowing the elastic member to relax.

43. The method of claim 42, wherein the method further comprises providing a second functional covering filament,within the air jet, covering the elastic member and the first functional covering filament with a second functional covering filament; and allowing the elastic member to relax.

44. The method of claim 42, wherein the method further comprises providing an inelastic synthetic polymer yarn,within the air jet, covering the elastic member and the functional covering filament with an inelastic synthetic polymer yarn; and allowing the elastic member to relax.

45. The method of claim 44, wherein the method further comprises providing a second inelastic synthetic polymer yarn, within the air jet, covering the elastic member, the functional covering filament and the first inelastic synthetic polymer yarn with a second inelastic synthetic polymer yarn; and allowing the elastic member to relax.

46. A fabric comprising a plurality of functional elastic composite yarns, wherein each functional elastic composite yarn comprises:

an elastic member having a relaxed unit length L and a drafted length of (N×L), wherein N is in the range of about 1.0 to about 8.0; and at least one functional covering filament around the elastic member, the functional covering filament having a length that is equal to or greater than the drafted length of the elastic member, wherein the functional covering filament adds at least one property to the yarn selected from the group consisting of biological, electrical, optical, magnetic, thermoresponsive, sensory and actuation properties such that substantially all of an elongating stress imposed on the composite yarn is carried by the elastic member.

47. The fabric of claim 46, wherein one or more of the composite yarns further comprise:

an inelastic synthetic polymer yarn surrounding the elastic member, and wherein the inelastic synthetic polymer filament yarn has a total length less than the length of the functional covering filament, such that a portion of the elongating stress imposed on the composite yarn is carried by the inelastic synthetic polymer yarn.

48. The functional elastic composite yarn of claim 1, wherein N is about 1.2 to about 4.0.

* * * * *

UNITED STATES PATENT AND TRADEMARK OFFICE

CERTIFICATE OF CORRECTION

PATENT NO. : 7,946,102 B2
APPLICATION NO. : 11/719105
DATED : May 24, 2011
INVENTOR(S) : Eleni Karayianni et al.

It is certified that error appears in the above-identified patent and that said Letters Patent is hereby corrected as shown below:

Column 13, lines 26-33, Claim 16 should read as follows:

16. The functional elastic composite yarn of claim 15, wherein the second functional covering filament is (a) a composite comprising a polymer matrix selected from the group consisting of a polyester, a nylon, a polyolefin, and an acrylic, and a sufficiently high loading of particulates, or (b) is a hollow fiber, and wherein the breaking strength of the second functional covering filament is lower than the breaking strength of the functional composite yarn.

Column 14, lines 36-41, Claim 29 should read as follows:

29. The functional elastic composite yarn of claim 27, wherein the second inelastic synthetic polymer ~~yarns~~ yarn is sinuously disposed about the elastic member such that for each relaxed unit length (L) of the elastic member there is at least one period of sinuous covering by each inelastic synthetic polymer yarn.

Colum 14, lines 42-58, Claim 30 should read as follows:

30. A method for forming a functional elastic composite ~~yam~~ yarn, comprising:
(1) providing:
(a) an elastic member having a relaxed length; and
(b) at least one nonmetallic functional covering filament;
(2) drafting the elastic member;
(3) placing the functional covering filament substantially parallel to and in contact with the drafted length of the elastic member; and
(4) allowing the elastic member to relax to entangle the elastic member and the functional covering filament to form the composite yarn,
wherein the at least one functional covering filament adds at least one property to the yarn selected from the group consisting of biological, electrical, optical, magnetic, thermo-responsive, sensory and actuation properties.

Signed and Sealed this
Twelfth Day of July, 2011

David J. Kappos

David J. Kappos
*Director of the United States Patent and Trademark Office*